United States Patent [19]

Mueller

[11] 4,384,617

[45] May 24, 1983

[54] CHIMNEY FIRE PREVENTION DEVICE AND TAR TRAP

[76] Inventor: Anton C. Mueller, Rt. 1, Box 413, Sullivan, Mo. 63080

[21] Appl. No.: 226,444

[22] Filed: Jan. 19, 1981

[51] Int. Cl.[3] ..... A62C 37/12

[52] U.S. Cl. ..... 169/57; 98/67

[58] Field of Search ..... 169/54, 51, 56, 57, 169/61, 65, 46, 47, 26; 98/67, 66 R, 58–60; 52/245, 232

[56] References Cited

U.S. PATENT DOCUMENTS

| | | | |
|---|---|---|---|
| 666,299 | 1/1901 | Wood | 98/67 |
| 737,493 | 8/1903 | Samuel | 98/67 |
| 883,149 | 3/1908 | Shafer | 169/57 |
| 1,143,354 | 6/1915 | Bosch | 169/54 |
| 1,719,371 | 6/1929 | Holt et al. | 169/40 |
| 1,813,367 | 7/1931 | Thompson | 169/46 |
| 1,889,483 | 11/1932 | Seine | 169/46 |
| 2,297,808 | 10/1942 | Soucy | 169/61 |
| 2,501,011 | 3/1950 | Smart et al. | 98/58 |
| 2,581,992 | 1/1952 | Wilder | 98/67 |
| 2,635,526 | 4/1953 | Anderson | 98/67 |
| 3,654,996 | 4/1972 | Naglowsky | 169/57 |

FOREIGN PATENT DOCUMENTS

| | | | |
|---|---|---|---|
| 313126 | 4/1918 | Fed. Rep. of Germany | 169/57 |
| 586992 | 4/1925 | France | 169/57 |

*Primary Examiner*—H. Grant Skaggs
*Assistant Examiner*—Kenneth Noland
*Attorney, Agent, or Firm*—Glenn K. Robbins

[57] ABSTRACT

A chimney fire prevention device and tar trap. The device is seated on the top of a chimney or stove pipe and is comprised of a perforate support for a plastic sheet seal supporting a fire quenching material such as baking soda with sand as a weight agent. The plastic sheet withstands the temperature of normal flue gases but should a chimney fire develop the increased temperature melts the plastic seal and releases the fire quenching material to extinguish the fire. The tar trap is comprised of an open top sleeve on the interior of the device to collect condensed tars to trap the liquid tars or resins from wood fires and can be emptied periodically.

8 Claims, 5 Drawing Figures

CHIMNEY FIRE PREVENTION DEVICE AND TAR TRAP

SUMMARY OF THE INVENTION

In the past it has been a problem to prevent chimney or stove pipe fires. Such fires within a chimney annually cause great damage by fires in households and other buildings with tragic loss of life. A major cause of such fires is the collection of condensed tars or resins from the burning of wood in fireplaces or stoves which over a period of time collect on the interior of the chimney and when ignited burn with great heat and in many cases each year spread the fire to the building in which the fireplace, stove, furnace or the like is contained.

By means of this invention there has been provided a fire quenching device which may be simply installed at the top of a chimney or stove pipe. Upon the chimney catching fire the heat of the fire causes the melting of a plastic seal which supports a fire quenching material causing the gravity release of the quenching material into the chimney to quench the fire. A weighting agent may be employed with the quenching material to facilitate the release and ensure rapid gravity release.

The fire quenching device employs a fire resistant perforate support member which supports the plastic seal and serves as a bottom of a box-like container which contains the fire quenching material. A removable top closure for the box-like container provides convenient access for filling.

In order to minimize the collection of condensed tars on the interior of the chimney a tar trap device is also provided. The tar trap is comprised of annular inner and outer sleeves connected at the bottom to provide a reservoir for collected tar. The trap is positioned at the top of the chimney and by a laterally extending rest member may be rested on the top thereof with the sleeve extending downwardly into the chimney top.

The top of the inner sleeve terminates substantially below the top of the outer sleeve the exposed portion serves as a collecting or condensing surface for the tar which flows downwardly into the pocket or tar reservoir comprising the tar trap.

The fire quenching device and tar trap are simply and efficiently connected together in a manner that lends itself to the use in a variety of chimneys or stove pipes of different cross-sectional configurations. The tar trap sleeves are generally congruent in cross-section to that of the chimney and may be simply placed over the top of the chimney with the fire quenching device supported on top of the tar trap by a clamp fitting over an extension of the outer sleeve. The fire quenching device is supported in spaced relation by vertical struts to provide an open space for the escape of chimney or flue gas.

The fire quenching device and tar trap may be simply fabricated of sheet metal or the like and can be simply installed in houses, cabins and other buildings by the average householder with ease. The rugged and simple construction make possible the use in wide variety of chimneys and stove pipes for general application.

The above features are objects of this invention. Other objects will appear in the detailed description and will be otherwise apparent to those skilled in the art.

For the purpose of illustration of this invention, there is shown in the accompanying drawing a preferred embodiment thereof. It is to be understood that the drawing is for the purpose of example only and that the invention is not limited thereto.

IN THE DRAWING

DESCRIPTION OF THE INVENTION

Figure 1:
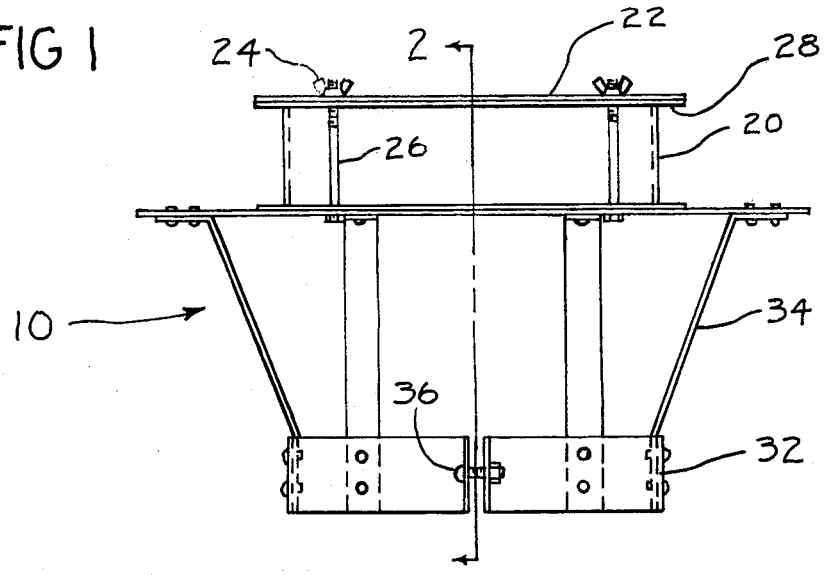
FIG. 1 is a view in side elevation of the fire prevention device of this invention.
Figure 2:
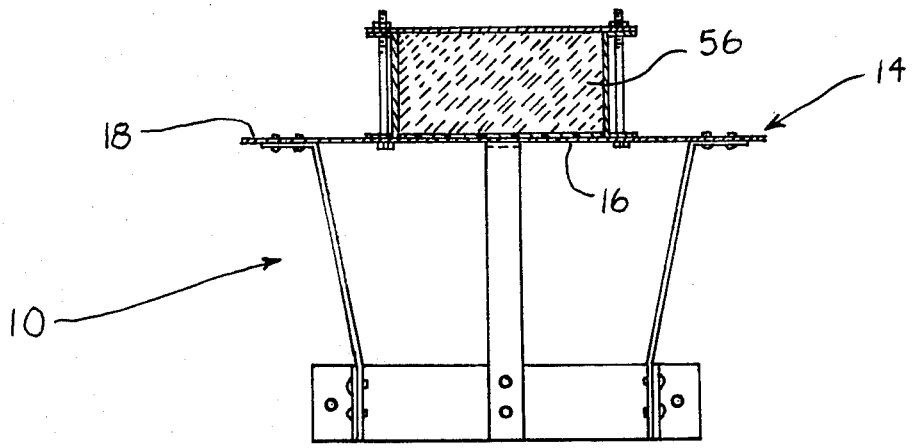
FIG. 2 is a cross-sectional view taken on the line 2—2 of FIG. 1.
Figure 3:
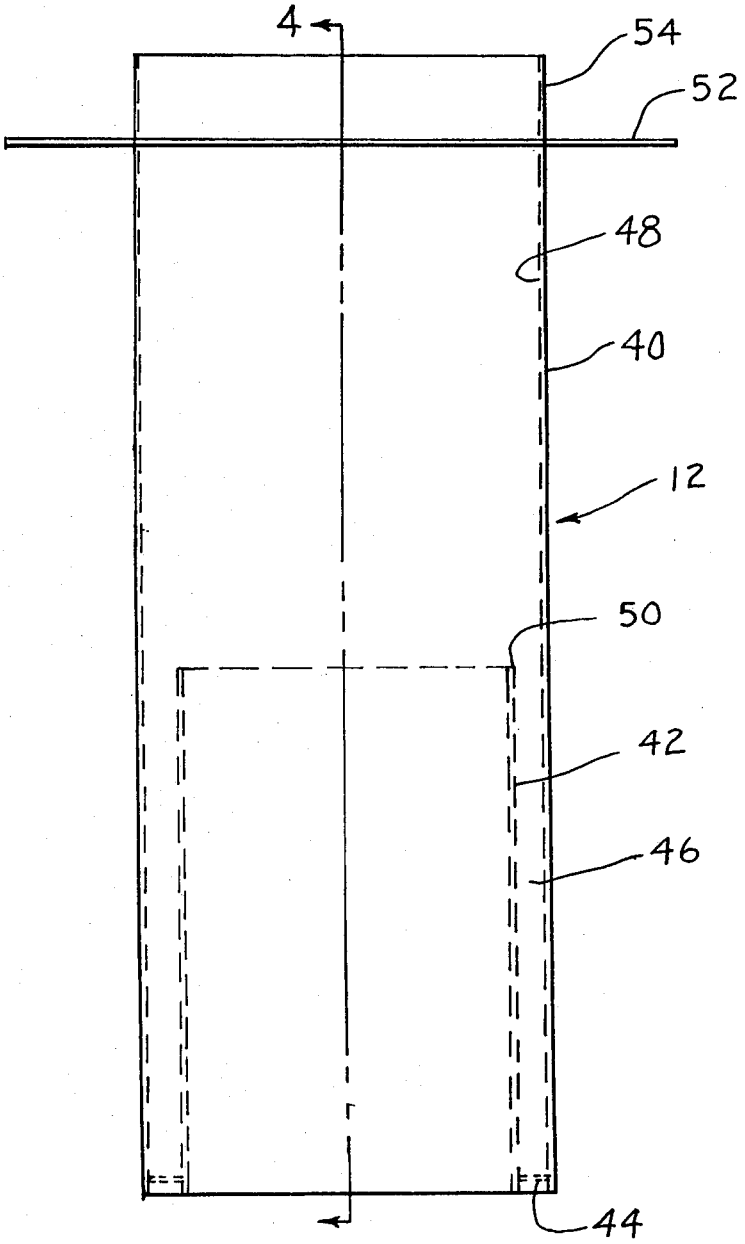
FIG. 3 is a view in side elevation of the tar trap.
Figure 4:
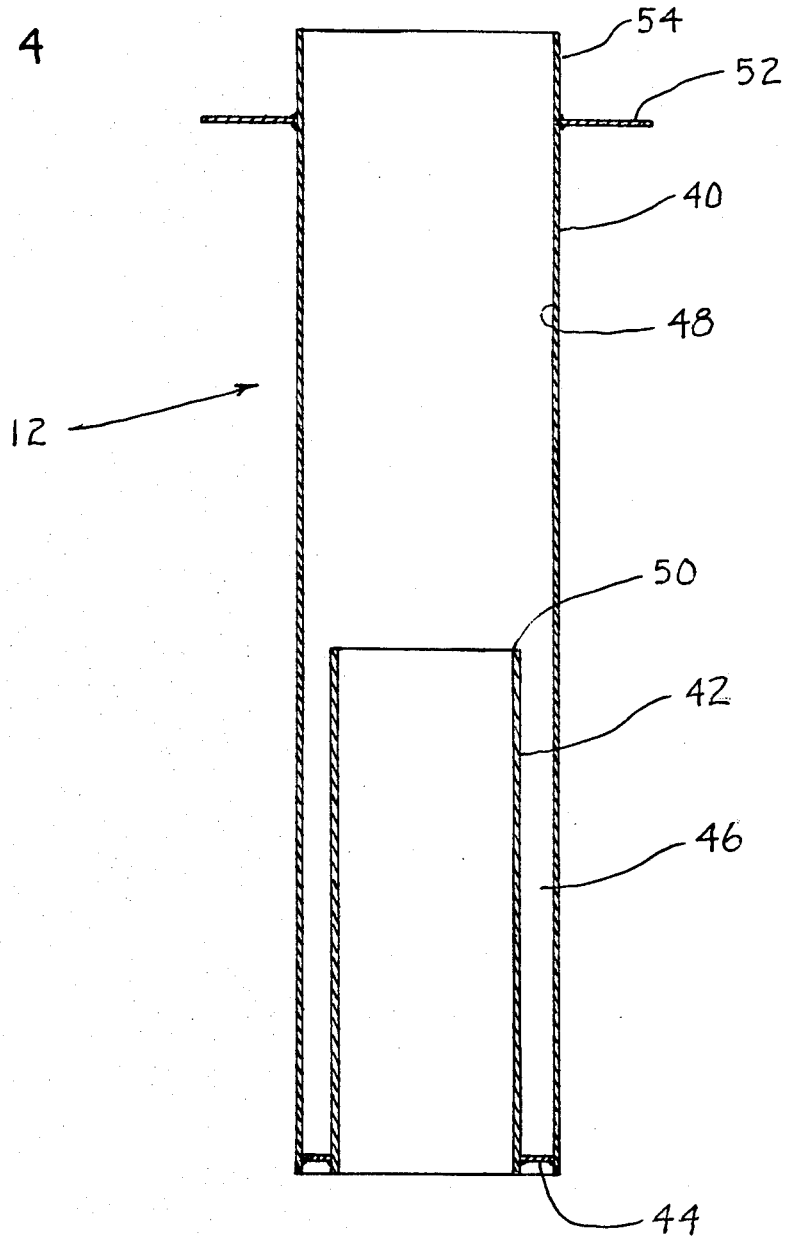
FIG. 4 is a cross-sectional view taken on the line 4—4 of FIG. 3.
Figure 5:
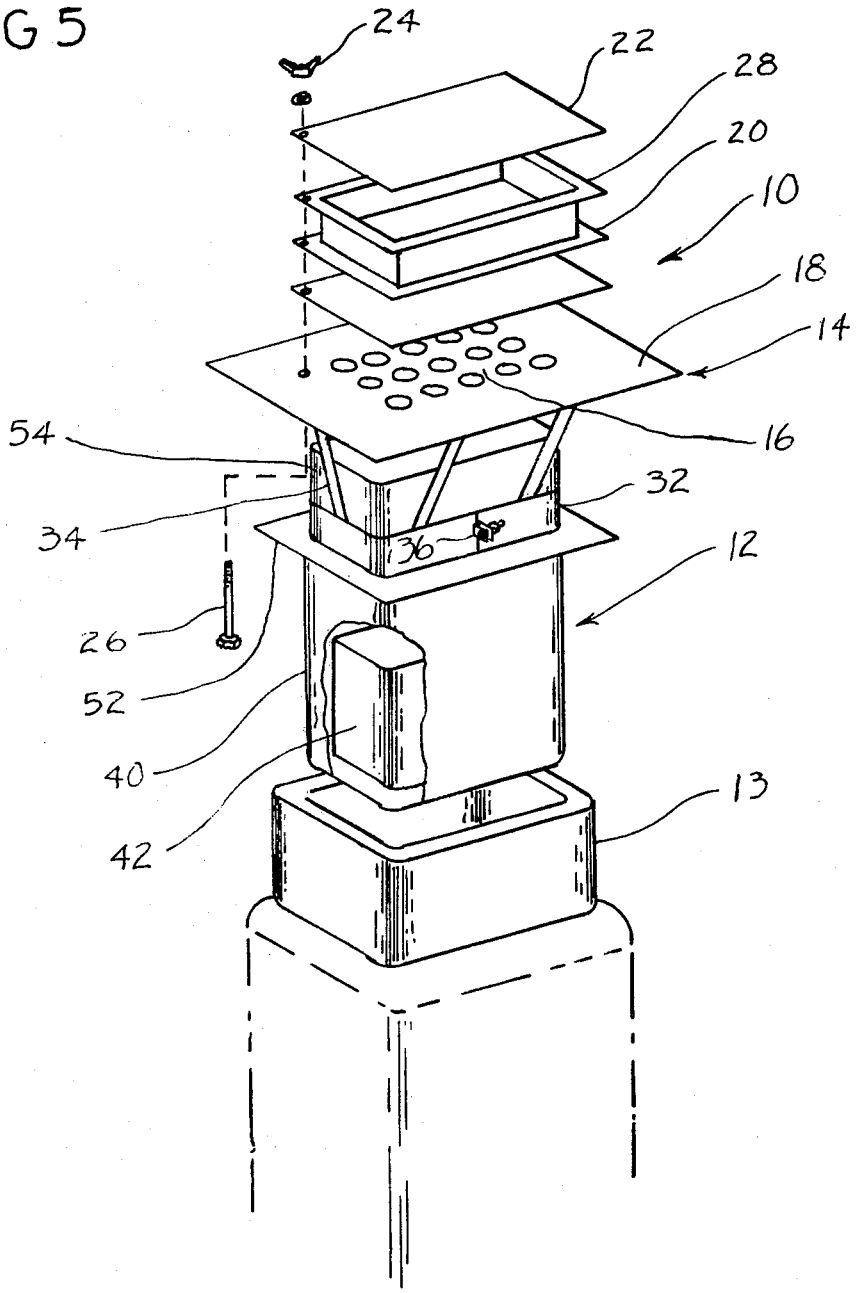
FIG. 5 is a pictorial exploded view of the fire prevention device, the tar trap and a chimney showing the support relationship.

The fire quenching device of this invention is generally indicated by the reference numeral 10 and is best shown in FIGS. 1, 2 and 5. The tar trap is generally indicated by reference numeral 12 and is best shown in FIGS. 3, 4 and 5. The fire quenching device and tar trap are shown in exploded view in FIG. 5 in the relation in which they are assembled and supported on a chimney top 13.

The fire quenching device is comprised of a flat roof member 14 of sheet metal or the like having a central perforate section 16 and a surrounding imperforate section 18.

An open box-like member 20 is connected to the top of the roof member enclosing the perforate section 16 and receives a flat top closure plate 22 which is adapted to seal the box-like member by tightening thumb screws 24 on bolts 26 passing between the imperforate section 18 of the roof member through a laterally extending flange 28 at the top of the box-like member 20.

A thermoplastic seal 30 is supported within the box-like member over the perforate section to provide a sealed closure. The thermoplastic seal may be made of conventional thermoplastic film such as polyethylene or the like having a sufficient thickness such as for example, four millimeters of an inch, to withstand the weight of the fire quenching material and weighting agent with which the box-like member is charged. It has been found that conventional thermoplastic fire material of substantial gauge withstands the normal temperature of chimney or flue gases at the top of the chimney but melts at the high temperatures occasioned by chimney fires.

The fire quenching material employed may be baking soda found in the average household, sodium bicarbonate or other fire quenching materials which, when contacted with a fire will quench or extinguish the flame as will be well understood in the art. The quenching material is desirably a material that will flow under all ambient temperature conditions and can be readily obtained to charge the box-like reservoir.

In order to provide free flowing of the fire quenching material to cause it to flow rapidly through the perforate section of roof member upon the melting of the plastic seal when a chimney fire occurs, a weighting agent is employed. The weighting agent may preferably be sand which is readily available and through its discrete particle size when mixed about half and half by volume with the fire quenching material provides a rapid discharge by gravity through the holes in the roof member when the plastic seal melts. It will be understood that the ratio of mixing of the weighting agent and the fire quenching material may be varied as desired and depending on the nature of the fire quenching material employed. It will also be understood that other discrete weighting agents may be employed.

In order to support the fire quenching device above a chimney or stove pipe or the like in spaced relation to provide for venting of chimney gas a clamp 32 is provided underneath the roof member and is connected thereto by struts 34. The clamp is adapted to clamp upon a chimney or stove pipe by a tightening screw 36.

The tar trap 12 as shown in FIGS. 3, 4 and 5 is comprised of an outer sleeve 40 having a cross-section generally congruent with the interior cross-section of the chimney top 13 within which it is designed to be nested. An annular inner sleeve 42 is connected at the bottom to the outer sleeve by a bottom wall 44 to provide a trap or reservoir 46 for condensed tars. A collecting or condensing surface 48 is formed at the upper portion of the interior of the outer sleeve which extends above the top 50 of the inner sleeve which for purpose of example is somewhat less than about half the height of the outer sleeve.

In order to support the tar trap upon the top of the chimney, a rest member 52 is provided. The rest member is comprised of an outwardly extending lateral flange which serves as a rest or stop upon the chimney top when the tar trap is inserted inside the chimney.

The outer sleeve has an extended stub portion 54 protruding above the rest member. The stub portion serves as a support for the clamp of the fire quenching device. When so attached the fire quenching device and tar trap may be simply inserted as a unit upon a chimney top or separately as desired. Likewise the fire quenching device may be removed as desired from the tar trap for disassembly or recharging as the occasion demands.

USE

The fire quenching device and tar trap of this invention are very simply installed by the average householder. In such installation the fire quenching device is simply filled by inserting a mixture of the fire quenching material and weighting agent indicated by the reference numeral 56 within the open box-like member 20. The top closure member is then closed and tightened by the thumb screws or wing nuts 24.

When so filled the tar trap and fire quenching device may be clamped together and placed upon the chimney top as a unit or separately as desired by first inserting the tar trap within the chimney top 13 and then clamping the clamp 32 to the stub portion 54 of the tar trap. When so connected the fire quenching device and tar trap are ready for use.

In use the tar trap over a period of time will collect condensed tars or resins in the reservoir 46 and which may be condensed on the condensing surface 48 which is relatively cooler than lower portions of the chimney. Through the nature of the construction of the tar trap it may be simply disassembled and removed for clean out of the collected tar and then reinserted. The trapping and removal of such tars minimizes condensations, collections and buildup of tars in lower and hotter portions of the chimney and greatly reduces the danger of chimney fires.

The fire quenching device serves as an important safety feature in the event of occurrence of any chimney fire. Should such a fire occur the high temperature created by the combustion within the chimney will cause the rapid melting of the plastic seal over the perforate section 16 of the roof member. The fire quenching material and weighting agent are then dumped by gravity into the chimney to act as fire extinguisher to quench or extinguish the fire.

After the fire has been extinguished the fire quenching device may be simply recharged by removing the top closure. A new plastic seal is inserted in the box-like member and a new charge of fire quenching material and weighting agent is introduced and the top closure member is closed.

Various changes and modifications may be made within this invention as will be readily apparent to those skilled in the art. Such changes and modifications are within the scope and teaching of this invention as defined by the claims appended hereto.

What is claimed is:

1. A fire prevention device for chimneys and the like to prevent overheating or burning of the interior of a chimney which comprises means for attaching the device to the open top of a chimney, a thermoplastic support seal spaced above said chimney top, a fire quenching material supported upon said seal and a perforated fire resistant support member supporting said plastic seal, said thermoplastic support seal having a melting temperature above the normal temperature of flue gases existing from said chimney and below the flame temperatures of a chimney fire to be extinguished, said device being spaced above said chimney and extending laterally thereover to provide a protective roof-like means extending over a chimney outlet and beyond the edges of said outlet to provide a cover therefore, said perforate fire resistant member having a perforate section underlying said seal and the fire quenching material and a laterally extending imperforate section surrounding said perforate section to serve as a portion of said protective roof-like means over the chimney.

2. A fire prevention device for chimneys and the like to prevent overheating or burning of the interior of a chimney which comprises means for attaching the device to the open top of a chimney, a thermoplastic support seal spaced above said chimney top, a fire quenching material supported upon said seal and a perforate fire resistant support member supporting said plastic seal, said thermoplastic support seal having a melting temperature above the normal temperature of flue gases existing from said chimney and below the flame temperatures of a chimney fire to be extinguished, a tar trap means is provided, said tar trap means comprising an inner and outer concentric annular sleeve member having a closed bottom and an open top for collecting condensed tars or resins form the combustion fuel.

3. The fire prevention device of claim 2 in which said tar trap means has means supporting it underneath the fire quenching material in spaced relation thereto and is connected thereto by substantially vertical support struts to provide an escape opening for chimney flue gas.

4. The fire prevention device of claim 2 in which said inner sleeve has an upper edge terminating substantially below a top edge of said outer sleeve to provide an exposed tar condensing surface at the upper portion of said outer sleeve.

5. The fire prevention device of claim 2 in which said outer sleeve nests closely within the top of the chimney and a laterally extending rest member is connected to said outer sleeve, said rest member serving to rest on the top of the chimney to support said tar trap means thereon.

6. The fire prevention device of claim 5 in which said outer sleeve has a cross-section generally congruent with the cross-section of the interior of said chimney.

7. The fire prevention device of claim 6 in which said outer sleeve extends above said rest member a circumferential clamp member is connected thereto and said support struts are connected at a bottom portion to said clamp.

8. A tar trap device for chimneys and the like to collect tar to minimize chimney fires, said device comprising inner and outer concentric annular sleeve members defining an annular chamber having substantially vertical side walls, a closed bottom and an open top for collecting condensed tars or resins from the combustion fuel, said inner sleeve having an upper edge terminating substantially below a top edge of said outer sleeve to provide an exposed tar condensing surface at the upper portion of said outer sleeve, said tar condensing surface being positioned exteriorly of said inner sleeve throughout its extent and forming at an upper edge an unobstructed chimney outlet, said outer sleeve nesting closely within the top of the chimney and having a laterally extending rest member connected to said outer sleeve, said rest member serving to rest on the top of the chimney to support said tar trap means thereon, said outer sleeve extending above said rest member, a circumferential clamp member connected thereto and rigid support struts connected at a bottom portion to said clamp for supporting roof means connected to a top portion of said struts, said roof means extending over and covering the chimney outlet, said support struts being circumferentially spaced to provide an air space for smoke outlet.

* * * * *